United States Patent [19]

Mizuno

[11] Patent Number: 5,040,909

[45] Date of Patent: Aug. 20, 1991

[54] IMPACT DOT PRINTER HAVING A RING-SHAPED MAGNETIC BYPASS MEANS

[75] Inventor: Shigeki Mizuno, Suwa, Japan

[73] Assignee: Seiko Epson Corporation, Tokyo, Japan

[21] Appl. No.: 406,642

[22] Filed: Sep. 12, 1989

[30] Foreign Application Priority Data

Sep. 13, 1988 [JP] Japan ..... 63-229601
Dec. 6, 1988 [JP] Japan ..... 63-308605

[51] Int. Cl.[5] ..... B41J 2/27
[52] U.S. Cl. ..... 400/124; 101/93.05
[58] Field of Search ..... 400/124, 157.2; 101/93.05, 93.29

[56] References Cited

U.S. PATENT DOCUMENTS 4,555,192 11/1985 Ochiai ..... 101/93.05
4,597,680 7/1986 Norigoe et al. ..... 400/124
4,895,404 1/1990 Rubinshtein ..... 400/124
4,913,569 4/1990 Koyama et al. ..... 400/124

FOREIGN PATENT DOCUMENTS 269959 11/1987 European Pat. Off. ..... 400/124
155056 9/1984 Japan ..... 400/124

*Primary Examiner*—Clifford D. Crowder
*Assistant Examiner*—John S. Hilten
*Attorney, Agent, or Firm*—Blum Kaplan

[57] ABSTRACT

An impact dot print head for driving a printing wire is provided. An armature has a printing wire mounted at one end and is attached to a leaf spring at its other end. A ring-shaped primary magnet provides a magnetic force for maintaining the armature in a stand-by condition. A plurality of coil electromagnets provided for each respective armature. The coil magnets form a ring having an inner circumference. A ring-shaped magnetic member is provided within the diameter of the ring formed by the coil electromagnets to reduce the magnetic interference between adjacent electromagnetic coils during driving of the printing wires.

4 Claims, 3 Drawing Sheets

IMPACT DOT PRINTER HAVING A RING-SHAPED MAGNETIC BYPASS MEANS

BACKGROUND OF THE INVENTION

The present invention relates generally to an impact dot printer, and in particular to an impact dot print head utilizing a coil magnet to effect printing.

Impact dot print heads are known in the art and contain a ring-shaped permanent magnet for maintaining a print armature in a non-print position. A plurality of electromagnets corresponding to each armature are positioned within the ring-shaped permanent magnet to cancel the magnetic force of the permanent magnet allowing printing. The electromagnets are positioned adjacent each other in a ring.

When a plurality of electromagnets are excited at the same time, a flux generated by the electromagnet travels through the cores of neighboring electromagnets. The flux travels in a direction which prevents the release of the armature so that the armature is insufficiently released providing an insufficient print force causing deterioration of print quality. This problem is one of magnetic interference.

To solve this problem in a conventional impact dot print head, a large amount of electrical energy is supplied to the electromagnets to reduce the influence of magnetic interference from adjacent magnetic cores. However, this method suffers from the disadvantage that it requires a large sized power source increasing the cost of the printer as well as limiting the printing operation due to the generation of heat from the electromagnets.

Accordingly, it is desired to provide an impact dot print head which overcomes the disadvantages of the prior art devices described above.

SUMMARY OF THE INVENTION

Generally speaking, in accordance with the present invention, an impact dot print head having an improved printing wire driving mechanism is provided. An impact dot print head has a plurality of wires supported on respective armatures. Each armature is attached to a leaf spring which drives the armature causing the printing wire to impact the print medium. A primary magnet maintains the armature in a non-printing position. A plurality of electromagnets are provided adjacent each armature to provide a magnetic force to counteract the magnetic force of the primary magnet allowing the armature to drive the printing wire. The electromagnets are placed adjacent one another in a ringed fashion. A ring-shaped magnetic member formed in a C-shape is placed within the inner circumference of the plurality of electromagnets. Accordingly, even if a plurality of electromagnets are excited at the same time, the flux generated by coils of the electromagnetic flows through the ring-shaped magnetic member and not into adjacent electromagnetic cores thereby reducing the influence of magnetic interference.

A cylindrical member is provided within the impact dot print head. The coil is press fitted onto the cylindrical member to be positioned. The ring shaped magnetic member is a C-shaped member so that an eddy current cannot flow in the circumferential direction of the ring-shaped magnetic member. Therefore, the flux flows through the ring-shaped magnetic member without being prevented by the eddy current reducing the influence of magnetic interference. The ring-shaped magnetic member is positioned about the cylindrical members so that the distance between the electromagnet and the ring-shaped magnetic member is made constant so the influence of the magnetic interference is equalized between electromagnets to achieve a uniform printing density.

Accordingly it is an object of the invention to provide an improved impact dot print head.

Another object of the invention is to provide an impact dot print head which consumes less power and reduces magnetic interference between the electromagnetic coils.

Still other objects and advantages of the invention will in part be obvious and will in part be apparent from the specification and drawings.

The invention accordingly comprises an apparatus embodying features of construction, combination of elements and arrangement of parts to be exemplified in the constructions hereinafter set forth and the scope of the invention indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 5:
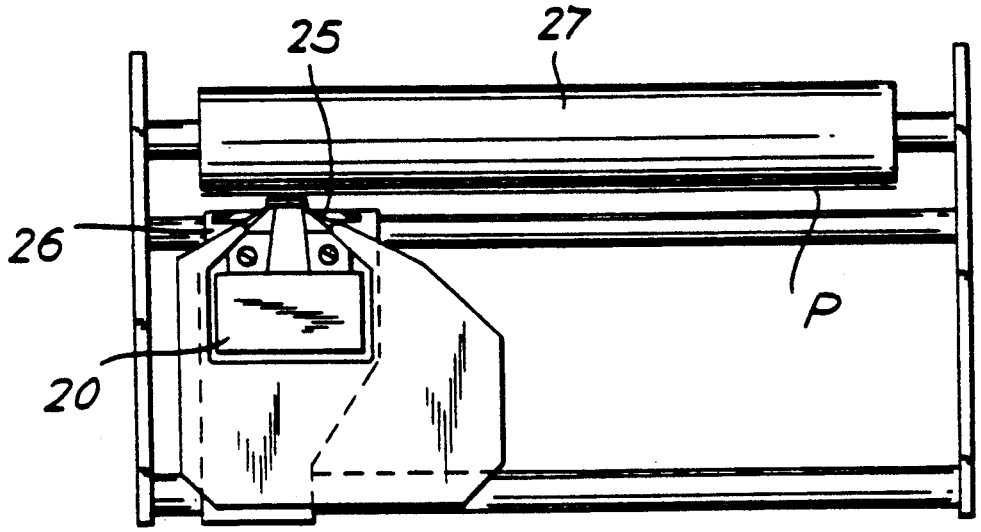
FIG. 5 is a top plan view of an impact dot printer in accordance with an alternative embodiment of the invention.

FIG. 5 schematically illustrates an impact dot printer in accordance with an alternative embodiment of the invention. Desired figures and characters are printed on printing paper P arranged between platen 27 and ink ribbon 25 by impact dot print head 20 mounted on carriage 26 movably supported in the printing direction.

Figure 1:
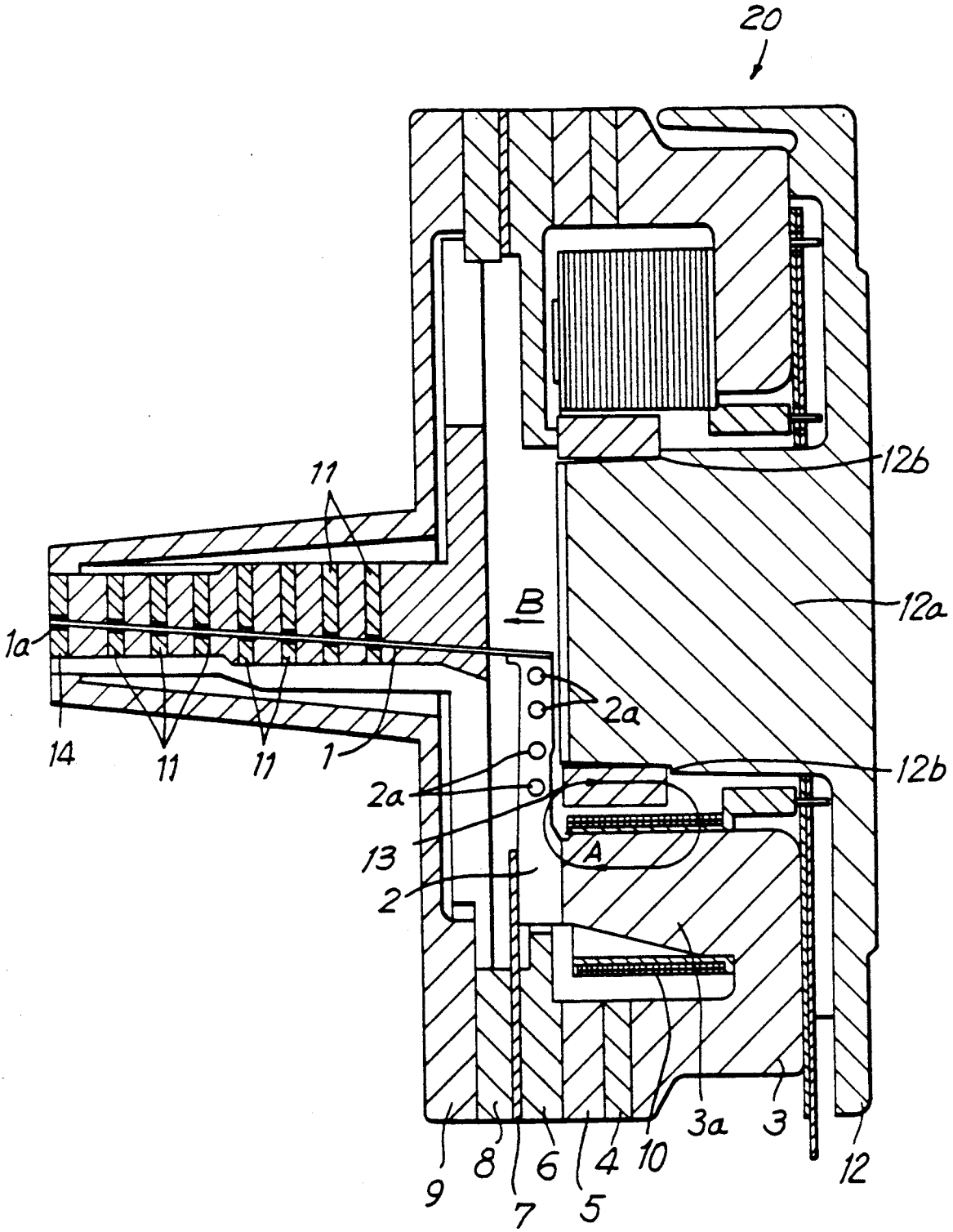
FIG. 1 is a cross-sectional view of an impact dot print head constructed in accordance with a first embodiment of the invention.

Reference is first made to FIG. 1 in which an impact dot print head, generally indicated as 20, constructed in accordance with the invention is depicted. Impact dot print head 20 includes a plurality of armatures 2 positioned within impact dot print head 20 in a ring pattern. A printing wire I made of high speed steel or hard metal is affixed on a distal end of a respective armature 2 utilizing a silver solder or the like. A guide frame 9 includes a plurality of wire guides 11 for maintaining and guiding print wire 1 during printing. The distal end 1*a* of print wire 1 is held by a distal end guide 14. In a preferred embodiment, distal end guide 14 is made of zirconia ceramics having good abrasion resistance. However, distal end guide 14 may also be made of almina ceramics and titania ceramics or the like.

Armature 2 is provided with a plurality of circular holes or openings 2*a* positioned in the vicinity of printing wire 1 to reduce the weight of armature 2. A leaf spring 7 is welded to armature 2 at the end of armature 2 opposite the end supporting printing wire 1. Leaf spring 7 is sandwiched between a spring pressing plate 8 and a side yoke 6. Side yoke 6 is adjacent a yoke plate 5 which is positioned against a permanent magnet 4.

Figure 2:
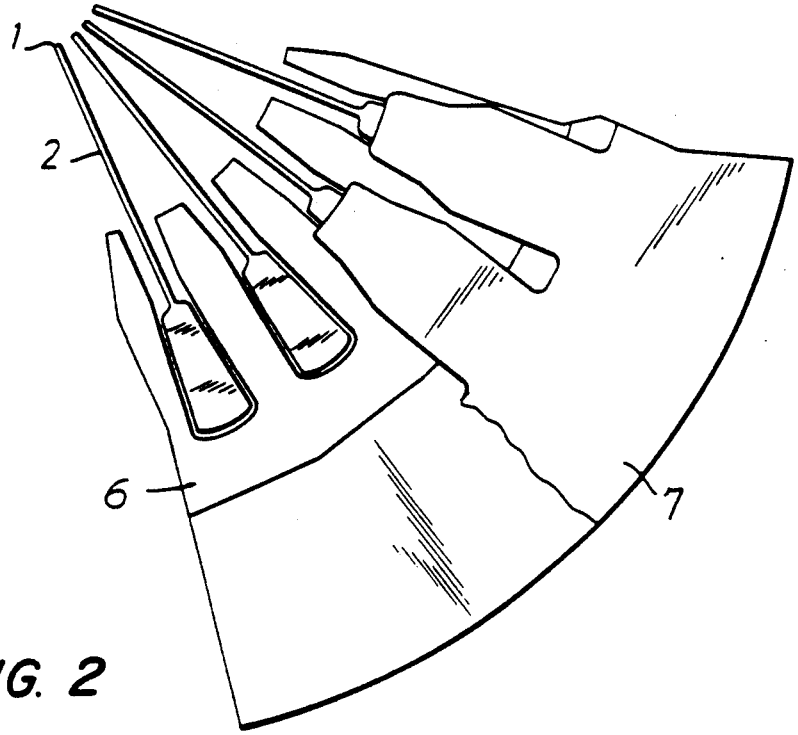
FIG. 2 is a partial top plan view of the side yoke and armature constructed in accordance with the invention.

As seen in FIG. 2, armature 2 has a varying cross-section so that the end of armature 2 supporting printing wire 1 is formed as a thin wall-shape and the end of armature 2 affixed to leaf spring 7 is formed as a thick wall-shape. Side yoke 6 is formed to be positioned externally from armature 2 and is separated from armature 2 by a space approximately 0.05 to 0.3 mm.

Permanent magnet 4 is formed in a ring shape. A ring-shaped base core 3 is positioned against permanent magnet 4 within impact dot print head 20. A respective core portion 3*a* of base core 3 opposes the lower end of each armature 2. A respective coil 10 is wound about each core 3*a* to form an electromagnet. In an exemplary embodiment, core 3*a* is made of silicon steel or iron cobalt alloy. An electromagnetic coil 10 is provided for each respective armature 2. Accordingly, a ring of electromagnet coils 10 is provided.

Figure 3:
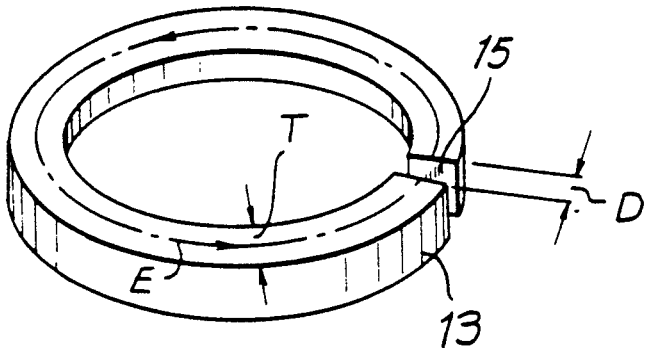
FIG. 3 is a perspective view of a bypass ring constructed in accordance with a first embodiment of the invention.

A back lid 12 includes a cylindrical member 12*a* disposed within the ring of magnetic coils 10. A ring-shaped magnetic member, inner circumference bypass ring 13, is positioned about cylindrical member 12*a* and pressed thereto. Inner circumference bypass ring 13 is formed in C-shape as seen in FIG. 3 in a perspective view. Accordingly, inner circumference bypass ring 13 has a cut out portion forming a gap 15 to provide the C-shaped cross-section. Inner circumference bypass ring 13 is formed of pure iron. However, it may also be formed of steel or such other material.

C-shaped bypass ring 13 is formed in a C-shape to prevent an electric current flow within bypass ring 13 in the direction shown by arrow E. To prevent such current flow, gap 15 is separated a distance D from approximately 0.03 to 0.3 mm. In an exemplary embodiment it is preferable to maintain gap 15 as small as possible. The inner diameter of inner circumference bypass ring 13 is made smaller than the outer diameter of cylindrical member 12*a* so that ring 13 may be pressed fit onto cylindrical member 12*a* which is formed of a truncated cone to provide interference. Because of gap 15, the diameter of ring 13 easily increases during press fitting. Additionally, since the diameter of ring 13 increases during press fitting to provide the press fit, the relative sizes of the parts need not be exactly accurate.

A step portion 12*b* is formed in cylindrical member 12*a* and inside circumference bypass ring 13 is press fitted so as to come into contact with step portion 12*b*. Thus, inner circumference bypass ring 13 is positioned in the direction of its height at the time it is fixed in position. Back lid 12 and base core 3 are positioned by a fitting jig when back lid 12 is attached to base core 3. Accordingly, the distance between a plurality of electromagnets consisting of coil 10 wound about core portion 3*a* of base core 3 and inner circumference bypass ring 13 can be made uniform.

During operation, a magnetic flux generated from permanent magnet 4 flows through yoke plate 5, side yoke 6, armature 2 and base core 3 to maintain armature 2 in a stand-by condition. Armature 2 is attracted towards and retained at the face of core portion 3*a* of base core 3 bending leaf spring 7. By letting current flow through coil 10 in a direction which negates the flux from permanent magnet 4, armature 2 is released from the attractive force of permanent magnet 4. Armature 2 then rotates in the direction of arrow b due to the distortion energy stored in leaf spring 7. This causes print wire 1 to project from print guide 9 and strike against a print medium to form dots. Once the striking has occurred, armature 2 is then attracted and held by core portion 3*a* of base core 3 by the resilient force resulting from the striking and the attractional force of permanent magnet 4 completing one printing cycle.

During printing, when current flows through coil 10 in the direction which negates the flux of permanent magnet 4, the portion of the flux generated by coil 10 forms a loop A which passes through bypass ring 13 positioned adjacent coil 10. Therefore, when a plurality of coils are simultaneously excited, loop A is formed for each respective coil 10. A respective loop A is formed and the amount of flux flowing to the neighboring core 3*a* becomes extremely small when compared to a print head not having inside circumference bypass ring 13. The influence of magnetic interference is reduced to achieve good printing quality. Additionally, it is no longer necessary to generate a great amount of electrical energy to prevent magnetic interference. This also reduces heat generation of the coils at the same time. Additionally, because a great amount of electricity is no longer needed, the capacity of the power source can be reduced resulting in an inexpensive smaller sized printer.

When loop A is formed, an eddy current is likely to be generated within inner diameter bypass ring 13 in the direction of arrow E (FIG. 3) to prevent loop A from being formed in inner circumference bypass ring 13 However, since inner circumference bypass ring 13 is formed in a C-shape, eddy currents do not flow in the direction shown by arrow E. Accordingly, the effect on magnetic interference provided by inside circumference bypass ring 13 is even greater. Providing gap 15 increases the reduction of magnetic interference by about 30%.

If the distance between the electromagnet, consisting of coil 10 and core portion 3*a*, and inner circumference bypass ring 13 is not maintained constant between each electromagnet, a difference of magnetic interference level between each electromagnet is produced. This causes unevenness in printing density. However, according to this embodiment, the distance between the electromagnet and inner circumference bypass ring 13 can be made constant to achieve uniform printing quality because inner circumference bypass ring 13 is positioned and fixed in the direction of its diameter and height by cylindrical member 12*a* of back lid 12.

Furthermore, the degree of effect on magnetic interference can be changed by changing a thickness T of inside circumference bypass ring 13 so that an appropriate condition can be obtained in each impact dot print head merely by changing the thickness of inner circumference bypass ring 13.

Figure 4:
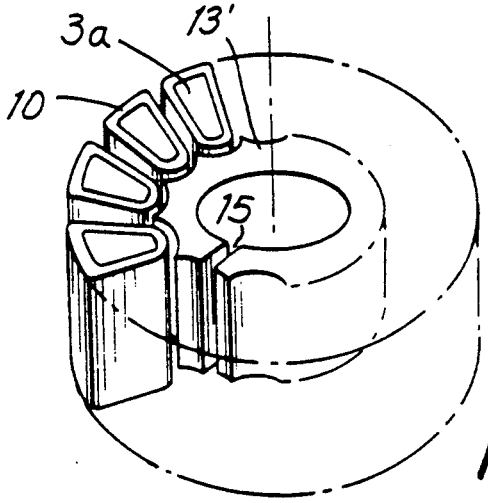
FIG. 4 is a perspective view of a bypass ring constructed in accordance with a second embodiment of the present invention.

Reference is now made to FIG. 4 which is a perspective view in which an inner circumference bypass ring 13' and coil 10 constructed in accordance with a second embodiment of the present invention. In the second embodiment, the outer circumference of inner circumference bypass ring 13' is formed with a serrated edge to better fit along the inner circumference of coils 10. The remaining structure of a second embodiment is identical to impact dot print head 20. In this embodiment, the same effect is provided with respect to magnetic interference however, the heat radiation property of the head is improved since the heat generated by coil 10 can be easily released through inner circumference bypass ring 13'.

It will thus be seen that the objects set forth above, among those made apparent from the preceding description are efficiently attained and, since certain changes may be made in the construction set forth, without departing from the spirit and scope of the invention, it is intended that all matter contained in the above description and shown in the accompanying drawings shall be interpreted as illustrative and not in a limiting sense.

It also to be understood that the following claims are intended to cover all the generic and specific features of the invention herein described and all statements of the scope of the invention which, as a matter of language might be said to fall therebetween.

What is claimed is:

1. An impact dot printer having an impact dot print head, said impact dot print head comprising at least one armature, a printing wire mounted at a first end of said armature, biasing means affixed to an end of said armature opposed from said printing wire for biasing said armature towards a print position, a ring-shaped permanent magnet for attracting said armature in a stand-by condition, a yoke, said yoke being positioned against said permanent magnet, a plurality of magnet means, each magnet means being associated with a respective armature to negate the attractive force of the permanent magnet allowing the driving of a printing wire toward said print position, said magnet means being formed in a substantially ring-shape and having an inner diameter thereof, and a ring-shaped magnetic bypass means formed of a magnetic substance being disposed inside the circumference of said plurality of magnet means in a vicinity of said armature and said magnet means and away from said yoke, said ring-shaped magnetic bypass means being formed as a C-shape.

2. The impact dot print head of claim 1 wherein said magnet means is an electromagnet having a core and a coil wound about said core.

3. The impact dot print head of claim 1, wherein said biasing means is a leaf spring.

4. An impact dot printer having an impact dot print head, said impact dot print head comprising at least one armature, a printing wire mounted at a first end of said armature, biasing means affixed to an end of said armature opposed from said printing wire for biasing said armature towards a print position, a ring-shaped permanent magnet for attracting said armature in a stand-by condition, a plurality of magnet means, each magnet means being associated with a respective armature to negate the attractive force of the permanent magnet allowing the driving of a printing wire toward said print position, said magnet means being formed in a substantially ring-shape and having an inner diameter thereof, and a ring-shaped magnetic bypass means formed of a magnetic substance being disposed inside the circumference of said plurality of magnet means in a vicinity of said armature and said magnet means, said ring shaped bypass means being formed as a C-shape, and a cylindrical member for receiving said ring-shaped magnetic bypass means in a press fit.

* * * * *